US006154895A

United States Patent [19]

Pisklak

[11] Patent Number: 6,154,895

[45] Date of Patent: Dec. 5, 2000

[54] DECORATIVE SINK APRON

[76] Inventor: Stephen G. Pisklak, 5912 Bullard Dr., Austin, Tex. 78757

[21] Appl. No.: 09/292,344

[22] Filed: Apr. 15, 1999

[51] Int. Cl.[7] ..... A47K 1/00

[52] U.S. Cl. ..... 4/660; 4/584; 4/619

[58] Field of Search ..... 4/538, 545, 584, 4/592, 593, 594, 595, 619, 630, 631, 635, 636, 643, 645, 647, 648, 649, 654, 658, 660, 901; 52/658

[56] References Cited

U.S. PATENT DOCUMENTS

| | | | |
|---|---|---|---|
| 494,557 | 4/1893 | Drukenbrod | 4/594 |
| 2,632,682 | 3/1953 | Corrigan | 4/654 X |
| 2,790,181 | 4/1957 | McCarthy | 4/660 X |
| 3,101,486 | 8/1963 | Tiller | 4/661 |
| 3,971,176 | 7/1976 | Rannels | 52/658 X |
| 4,160,295 | 7/1979 | Putyra | 4/632 |
| 5,490,291 | 2/1996 | Direnzo | 4/636 X |

FOREIGN PATENT DOCUMENTS

| | | | |
|---|---|---|---|
| 1035274 | 7/1966 | United Kingdom | 4/594 |
| 2035794 | 6/1980 | United Kingdom | 4/584 |

*Primary Examiner*—Robert M. Fetsuga
*Attorney, Agent, or Firm*—Patent & Trademark Services; Joseph H. McGlynn

[57] ABSTRACT

A decorative sink apron with curved corners. The exposed portion of the apron has brackets attached thereto and a decorative cover is secured to the brackets.

5 Claims, 1 Drawing Sheet

DECORATIVE SINK APRON

BACKGROUND OF THE INVENTION

This invention relates, in general, to sinks, and, in particular, to decorative covers for sinks.

DESCRIPTION OF THE PRIOR ART

In the prior art various types of sink accessories have been proposed. For example, U.S. Pat. No. 3,101,486 to Tiller discloses a lavatory fixture with brackets for securing an extension counter thereto.

U.S. Pat. No. 4,160,295 to Putyra discloses a covering for attachment to a toilet to conceal the fixture below the rim of the bowl U.S. Pat. No. 5,490,291 to Direnzo discloses a covering applied to a sink which conceals the joint between the sink and the surrounding counter top.

SUMMARY OF THE INVENTION

The present invention is directed to a decorative sink apron with curved corners. The exposed portion of the apron has brackets attached thereto and a decorative cover is secured to the brackets.

It is an object of the present invention to provide a new and improved cover for the exposed apron of a sink.

It is an object of the present invention to provide a new and improved cover which can be attached to a sink apron of any shape.

It is an object of the present invention to provide a new and improved cover which is inexpensive and can be easily retrofitted to existing sinks.

These and other objects and advantages of the present invention will be fully apparent from the following description, when taken in connection with the annexed drawings.

DESCRIPTION OF THE PREFERRED EMBODIMENT

Figure 1:
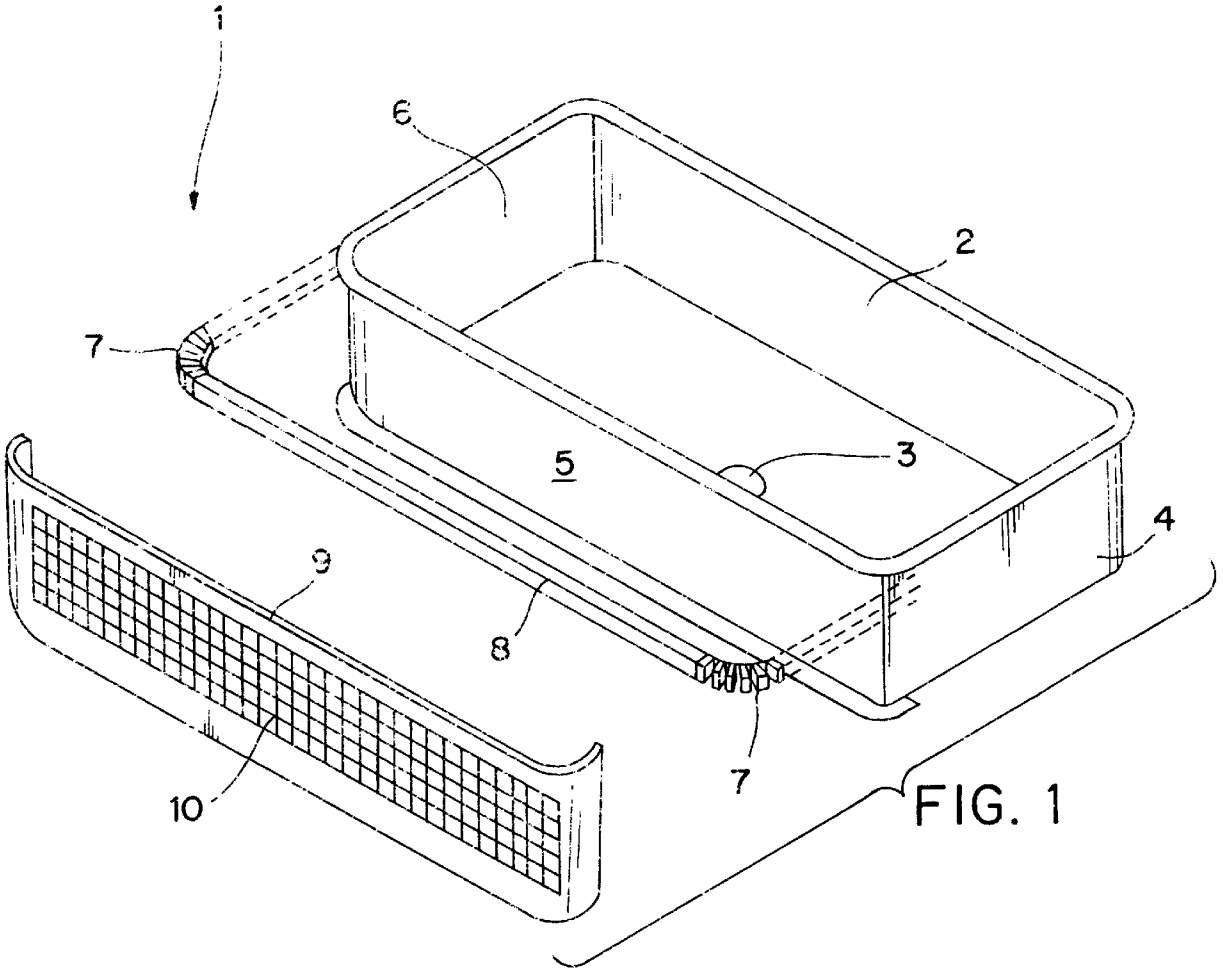
FIG. 1 is an exploded perspective view of the present invention.

Referring now to the drawings in greater detail, FIG. 1 shows the present invention attached to a conventional type sink referred to as a "Farmer Style" sink. This type of sink mounts flush with or protrudes from the front of a cabinet (not shown). Although the present invention is preferably used with a "Farmer Style" sink, it can be used with any type of sink in which the front portion 5 is exposed to view. Also, it should be noted that only the drain hole 3 is shown in FIG. 1 for reasons of clarity, and that other portions that are normally attached to the sink, such as the faucets or openings for the faucets, have been eliminated for illustration purposes. Also, it should be noted that other types of sinks can be used with the present invention.

The standard "Farmer Style" sink has an apron comprising front 5, sides 4, 6 and a back 2. Since the front and portions of the sides 4, 6 are exposed to view, it is desirable to hide these exposed portions to leave only a decorative cover 9 showing. The problem is how to attach a decorative covering to a curved surface such as the front 5 and the sides 4, 6.

The apron can be composed of various materials such as metals, plastics, composites or ceramics. The method used to attach the decorative cover 9 to a metal sink will have to be different than the method used to attach the decorative cover 9 to a ceramic sink, since adhesives, for example, which will adhere to metal will not always adhere to ceramic.

In order to avoid this type of problem and to make the attachment of the decorative cover 9 standard so it can be secured to any type of sink, mounting braces 8 are first secured to the apron 4, 5, 6 and then a standard method of adhering the decorative cover 9 to the mounting braces can be used.

Figure 2:
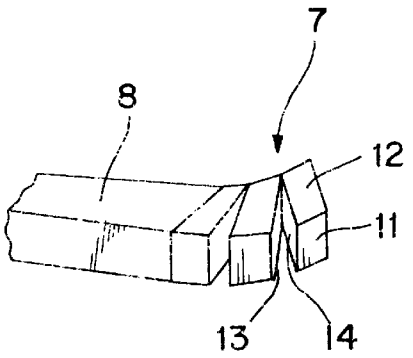
FIG. 2 is a partial enlarged view of one of the mounting bars of the present invention.
Figure 3:
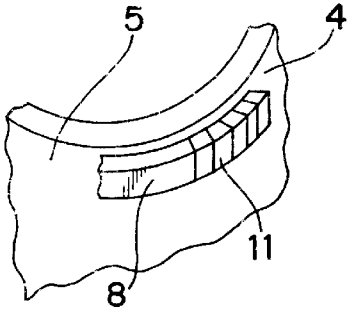
FIG. 3 is a partial enlarged view of one of the mounting bars of the present invention attached to the sink apron.

The preferred material used for the mounting braces 8 is a metal or rigid plastic and this introduces a new problem into attaching the decorative cover 9. Since the area where the front 5 meets the sides 4, 6 is rounded or curved, it will be necessary to bend the rigid mounting braces 8 around this rounded or curved portion. This is accomplished in the present invention by providing slots 13, as shown in FIG. 2 in the mounting braces 8 which will provide flexibility in the mounting braces 8 and will allow them to "turn the corner" between the front 5 and the sides 4, 6. The slots 13 are placed between portions of the front 11 of the bar 8 and the top 12 which will form wedge shaped segments with sides 14. By spreading the wedge shaped segments further apart or closer together, the bars 8 will adapt to the front 5 and the sides 4, 6.

Also, it should be noted that only a single bar 8 is shown in FIG. 1 for purposes of clarity, however, at least two bars 8 will be used to mount the decorative cover 9, and more than two bars can be used for larger sinks.

The bars 8 are attached by soldering if the apron is made from cooper, brass or bronze, and welding is used if the apron is made from stainless steel, and adhesives are used if the apron is plastic or ceramic. Once the bars are attached using which ever method is dictated by the various materials, the cover 9 can be attached to the bars 8. Since the material of the bars will always be the same, regardless of the material that the apron is made from, the cover 9 can be attached to the bars using the same method. The preferred method of attaching the cover 9 is using a compatible adhesive that will secure the cover to the bars 8. The decorative design 10 shown in FIG. 1 is a basket weave, however, this is merely for illustrational purposes and other designs can be used without departing from the scope of the invention.

Although the Decorative Sink Cover and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. In combination a sink having a front and sides, at least one mounting bar and a decorative cover, said sink being made from a first material, said mounting bar being made from a second material, and said decorative cover being made from a third material, said third material not being readily secured to said first material, said mounting bar having a plurality of slots extending from a front of said mounting bar toward a back of said mounting bar, said slots extend through said front of said mounting bar but do not extend through said back of said mounting bar, means for securing a front of said bar to said front of said sink, means for securing sides of said bar to said sides of said sink, means for securing said decorative cover to said front of said bar and to said sides of said bar.

2. A mounting system for attaching a decorative cover to a sink, in which the sink has a front and sides which are attached to the front by a curved surface, and in which the sink is made from a first material and the cover is made from a second material, said mounting system comprising:

at least one mounting bar adapted to be secured to said front and sides of said sink, said at least one mounting bar being made from a rigid material, said at least one mounting bar having a front portion which will be secured to said front of said sink, and two side portions which will be secured to said sides of said sink, means on said side portions of said mounting bar for allowing said mounting bar to bend from said front of said sink to said sides of said sink, and wherein said means on said side portions of said mounting bar for allowing said mounting bar to bend is a plurality of slots formed in said mounting bar, and wherein said slots extend from said front portion of said mounting bar toward a back portion of said mounting bar, but do not extend through said back portion of said mounting bar.

3. The mounting system as claimed in claim 2, in combination with a cover attached to said mounting bar.

4. A mounting system for attaching a decorative cover to a sink, as claimed in claim 2, wherein said mounting bar is attached to said sink by welding.

5. A mounting system for attaching a decorative cover to a sink, in which the sink has a front and sides which are attached to the front by a curved surface, and in which the sink is made from a first material and the cover is made from a second material, said mounting system comprising:

at least one mounting bar adapted to be secured to said front and sides of said sink, said at least one mounting bar being made from a rigid material, said at least one mounting bar having a front portion which will be secured to said front of said sink, and two side portions which will be secured to said sides of said sink, means on said side portions of said mounting bar for allowing said mounting bar to bend from said front of said sink to said sides of said sink, and wherein said mounting bar is attached to said sink by soldering.

* * * * *